US008773487B2

(12) United States Patent
Maeda et al.

(10) Patent No.: US 8,773,487 B2
(45) Date of Patent: Jul. 8, 2014

(54) IMAGE FORMING APPARATUS WITH PLURALITY OF OPTICAL SCANNING DEVICES

(71) Applicant: Kyocera Document Solutions Inc., Osaka (JP)

(72) Inventors: Ryota Maeda, Osaka (JP); Naoki Iwami, Osaka (JP); Hiroshi Yamashita, Osaka (JP)

(73) Assignee: Kyocera Document Solutions Inc. (JP)

( * ) Notice: Subject to any disclaimer, the term of this patent is extended or adjusted under 35 U.S.C. 154(b) by 0 days.

(21) Appl. No.: 13/777,108

(22) Filed: Feb. 26, 2013

(65) Prior Publication Data

US 2013/0222511 A1 Aug. 29, 2013

(30) Foreign Application Priority Data

Feb. 27, 2012 (JP) ..... 2012-040058

(51) Int. Cl.
*B41J 15/14* (2006.01)
*B41J 27/00* (2006.01)

(52) U.S. Cl.
USPC ..... 347/243; 347/261

(58) Field of Classification Search
USPC ..... 347/229, 231, 234, 235, 243, 244, 347/248–250, 258–261
See application file for complete search history.

(56) References Cited

U.S. PATENT DOCUMENTS

2005/0093962 A1* 5/2005 Miyatake et al. ..... 347/235
2012/0229585 A1* 9/2012 Higashiyama ..... 347/116

FOREIGN PATENT DOCUMENTS

JP 2000-214655 8/2000
JP 2005250250 A * 9/2005 ..... B41J 2/44
JP 2007-83514 4/2007

* cited by examiner

*Primary Examiner* — Hai C Pham
(74) *Attorney, Agent, or Firm* — Gerald E. Hespos; Michael J. Porco; Matthew T. Hespos

(57) ABSTRACT

An image forming apparatus includes an apparatus main body, a plurality of optical scanning devices, first temperature detectors for detecting the temperatures of the optical scanning devices, a second temperature detector for detecting the temperature of the apparatus main body, a first condition judger, a second condition judger and a temperature adjuster. The temperature adjuster performs a total motor drive process for driving the motors of all the optical scanning devices if a predetermined first condition is satisfied and a predetermined second condition is satisfied. On the other hand, the temperature adjuster drives the motor of the one optical scanning device and does not drive the motors of all the optical scanning devices excluding the one optical scanning device if the first condition is satisfied, but the second condition is not satisfied.

5 Claims, 5 Drawing Sheets

IMAGE FORMING APPARATUS WITH PLURALITY OF OPTICAL SCANNING DEVICES

This application is based on Japanese Patent Application Serial No. 2012-40058 filed with the Japan Patent Office on Feb. 27, 2012, the contents of which are hereby incorporated by reference.

BACKGROUND

The present disclosure relates to an image forming apparatus with a plurality of optical scanning devices and particularly to a technology for suppressing a scan position shift which occurs due to a temperature difference between optical scanning devices.

Conventionally, an image forming apparatus has been known which includes an image forming unit configured to form a toner image on a surface of a photoconductive drum and provided for each of a plurality of colors. The respective image forming units are arranged along a conveying direction of a recording sheet above a conveyor belt for conveying the recording sheet and transfer toner images of the respective colors to the recording sheet conveyed in the conveying direction in a superimposing manner.

In the image forming apparatus of this type, each image forming unit deflects laser light output from a light source by a scanning lens made of optical resin with good optical properties after reflecting the laser light by a rotational polygon mirror which is driven and rotated, whereby the laser light is scanned across the surface of the photoconductive drum at a constant speed. In this way, an electrostatic latent image is formed on the photoconductive drum surface.

Here, toner images of the respective colors formed on the photoconductive drums by attaching toners to electrostatic latent images need to be transferred in a superimposing manner so as not to cause any position shift on a recording sheet. To this end, a control is executed to adjust write positions (scan positions) of the electrostatic latent images on the surfaces of the photoconductive drums. For example, a control is executed to adjust the operations of the other rotational polygon mirrors so that the rotational polygon mirror in a predetermined image forming unit and those in the other image forming units rotate with predetermined phase differences.

However, if the temperatures of the respective image forming units differ due to usage frequencies and arranged positions of the respective image forming units, refractive indices of the optical resins forming the scanning lenses may change to be different from each other according to temperature. This may shift laser light paths among the respective image forming units. Even in the case of executing the above control, laser light scan positions may shift among the respective image forming units.

One conventional technology is known which suppresses laser light scan position shifts occurring due to such temperature differences among respective image forming units. According to this conventional technology, when image recording is performed by operating one of a plurality of image forming units, heating means of optical scanning devices in the other image forming units are also operated so that temperature differences of the optical scanning devices in the respective image forming units fall within a predetermined range.

Further, according to another conventional technology, an image of a specific color is formed by rotating a rotational polygon mirror necessary to form the image of the specific color at a rated rotating speed and other rotational polygon mirrors at a rotating speed lower than the rated rotating speed. This enables reductions in noise, vibration, smear of the optical scanning devices and the like while suppressing color shifts at the time of image formation.

However, the temperature of the optical scanning device used for single-color image formation is sufficiently reduced until the next image formation when air temperature near an image forming apparatus is low such as when the image forming apparatus is installed in a cold area. Thus, temperature differences from unused other optical scanning devices are unlikely to occur. If the above conventional technology is applied to drive heaters of the unused other optical scanning devices during single-color image formation in such a case, power is unnecessarily consumed, which is not preferable in terms of energy saving.

An object of the present disclosure is to suppress scan position shifts which occur due to temperature differences among respective optical scanning devices without unnecessarily consuming power.

SUMMARY

An image forming apparatus according to one aspect of the present disclosure includes an apparatus main body, a plurality of photoconductors housed in the apparatus main body, optical scanning devices, a mode receiver, a second temperature detector, a first condition judger, a second condition judger and a temperature adjuster.

The optical scanning devices are arranged in correspondence with the respective plurality of photoconductors and scan the corresponding photoconductors with laser light, and each of them includes a light source for emitting laser light, a rotational polygon mirror for reflecting the laser light output from the light source and scanning the photoconductor, a motor for rotating the rotational polygon mirror, and a first temperature detector for detecting the temperature of the optical scanning device. The mode receiver receives the selection of a single-color image forming mode for forming an image using only one of the plurality of optical scanning devices. The second temperature detector detects the temperature of the apparatus main body. The first condition judger judges whether or not a largest temperature difference out of temperature differences between temperature detected by the first temperature detector of the one optical scanning device and temperatures detected by all the first temperature detectors of the optical scanning devices excluding the first temperature detector of the one optical scanning device satisfies a first condition of being larger than a predetermined first temperature difference. The second condition judger judges whether or not the temperature detected by the second temperature detector satisfies a second condition of being higher than a predetermined temperature. The temperature adjuster performs a total motor drive process for driving the motors of all the optical scanning devices if the first condition is judged to be satisfied by the first condition judger and the second condition is judged to be satisfied by the second condition judger and, on the other hand, drives the motor of the one optical scanning device and does not drive the motors of all the optical scanning devices excluding the one optical scanning device if the first condition is judged to be satisfied by the first condition judger and the second condition is judged not to be satisfied by the second condition judger when the selection of the single-color image forming mode is received by the mode receiver.

These and other objects, features and advantages of the present disclosure will become more apparent upon reading the following detailed description along with the accompanying drawings.

DETAILED DESCRIPTION

Figure 1:
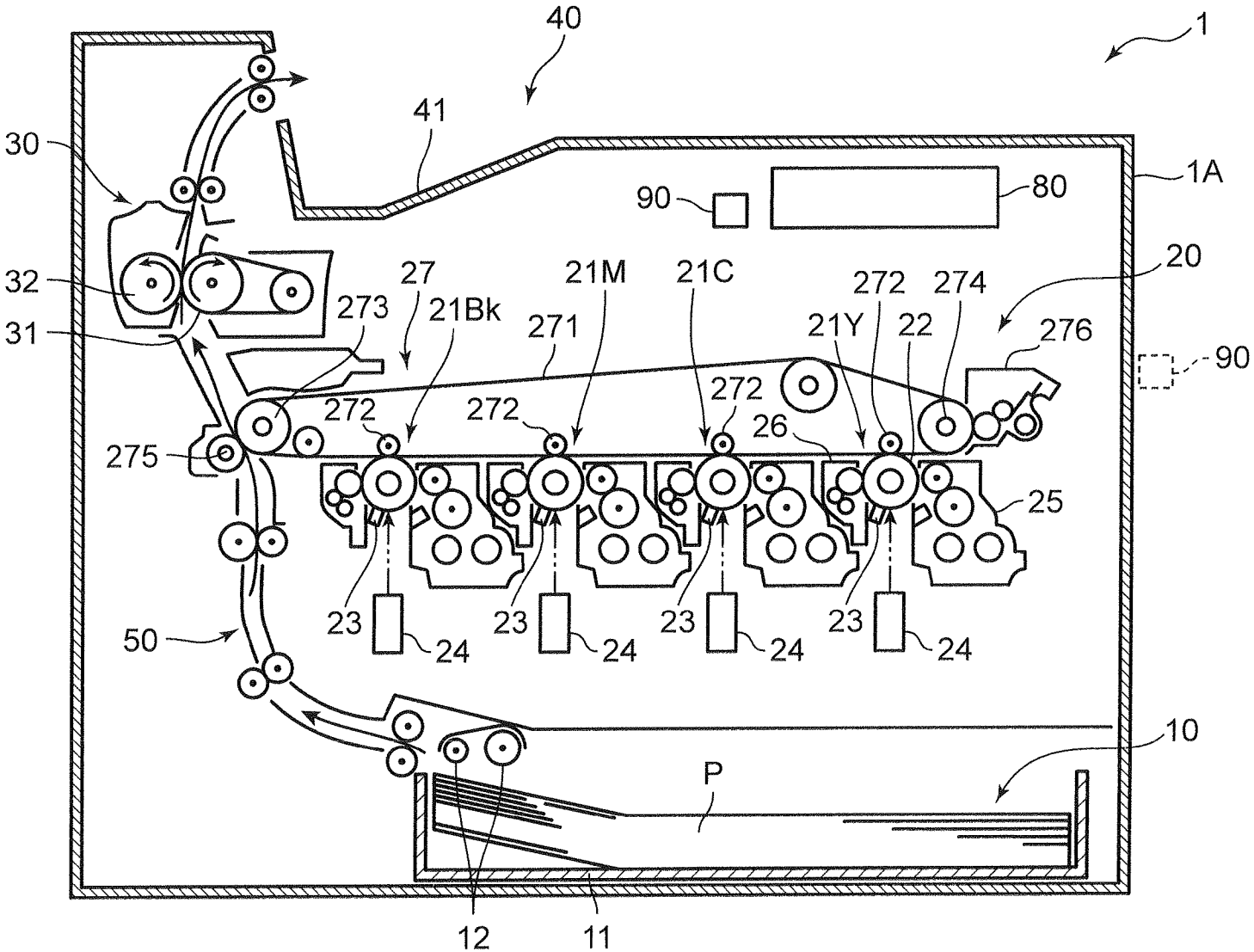
FIG. 1 is a schematic configuration diagram of a tandem color printer according to one embodiment of an image forming apparatus of the present disclosure.

Hereinafter, an embodiment according to the present disclosure is described based on the drawings. FIG. 1 is a schematic configuration diagram of a tandem color printer 1 as one embodiment of an image forming apparatus of the present disclosure.

As shown in FIG. 1, the color printer 1 includes a sheet storage unit 10, an image forming station 20, a fixing unit 30, a sheet discharge unit 40, a sheet conveyance path 50, a temperature sensor (second temperature detector) 90, and a control unit 80. Each unit excluding the sheet discharge unit 40 is housed in a substantially box-shaped apparatus main body 1A. The sheet discharge unit 40 is provided on top of the apparatus main body 1A.

The sheet storage unit 10 picks up a sheet P and feeds it under the control of the control unit 80. The sheet storage unit 10 includes a sheet cassette 11 which is insertable into and withdrawable from the apparatus main body 1A. Pickup rollers 12 for picking up sheets P one by one from a sheet stack are provided on an upstream end of the sheet cassette 11 (left upper side of the sheet cassette 11 in an example shown in FIG. 11). The sheet P picked up from the sheet cassette 11 by driving these pickup rollers 12 is fed to the sheet conveyance path 50.

The image forming station 20 applies an image transfer process to a sheet P under the control of the control unit 80. This transfer process is performed on each sheet P picked up from the sheet stack stored in the sheet storage unit 10 based on an image signal received by an unillustrated interface circuit from a computer or the like. The interface circuit is connected to an external apparatus such as a computer via a LAN (Local Area Network) or the like and transmits and receives various signals to and from the external apparatus. For example, a network interface (10/100Base-TX) or the like is used as the interface circuit.

The image forming station 20 includes image forming units 21Y, 21C, 21M and 21Bk of respective colors for forming toner images, and a transfer device 27 for transferring toner images formed by these image forming unit 21Y, 21C, 21M and 21Bk to a sheet P.

The four image forming units 21Y, 21C, 21M and 21Bk are arranged substantially in a horizontal direction from an upstream side (right side in FIG. 1) to a downstream side. The yellow image forming unit 21Y is arranged on the most upstream side and the cyan image forming unit 21C, the magenta image forming unit 21M and the black image forming unit 21Bk are arranged in this order thereafter. The respective image forming units 21Y, 21C, 21M and 21Bk have a similar configuration and are mounted in the apparatus main body 1A while being positioned to have a predetermined relative positional relationship with the respective devices in the apparatus main body 1A.

Each of the image forming units 21Y, 21C, 21M and 21Bk includes a photoconductive drum (photoconductor) 22, a charger 23, an optical scanning device 24, a developing device 25 and a cleaning device 26. The photoconductive drum 22 is rotatable about a drum shaft extending in forward and backward directions (directions orthogonal to the plane of FIG. 1). The charger 23, the optical scanning device 24, the developing device 25 and the cleaning device 26 are arranged in this order from a position right below the photoconductive drum 11 in a counterclockwise direction, which is a rotating direction of the photoconductive drum 22, along the circumferential surface of the photoconductive drum 22.

The photoconductive drum 22 has the circumferential surface on which an electrostatic latent image and a toner image in conformity with this electrostatic latent image are to be formed.

The charger 23 uniformly charges the circumferential surface of the photoconductive drum 22 rotating counterclockwise about the drum shaft with electric charges. The charger 23 includes a charging roller for applying electric charges to the photoconductive drum 22 while being rotated by having the circumferential surface thereof held in contact with the photoconductive drum 22.

The developing device 25 supplies toner to the circumferential surface of the photoconductive drum 22. The toner is attached to an electrostatic latent image on the circumferential surface of the photoconductive drum 22 by the toner supply, whereby a toner image is formed on the circumferential surface of the photoconductive drum 22. Note that yellow (Y) toner is contained in the developing device 25 of the yellow image forming unit 21Y, cyan (C) toner is contained in the developing device 25 of the cyan image forming unit 21C, magenta (M) toner is contained in the developing device 25 of the magenta image forming unit 21M and black (Bk) toner is contained in the developing device 25 of the black image forming unit 21Bk.

The cleaning device 26 performs cleaning by removing the toner remaining on the circumferential surface of the photoconductive drum 22 after primary transfer to be described later. The circumferential surface of the photoconductive drum 22 cleaned by this cleaning device 26 heads for the charger 23 again for the next image forming process.

The optical scanning device 24 irradiates the circumferential surface of the photoconductive drum 22 with laser light modulated based on image data. An irradiation position of the laser light is between the charger 23 and the developing device 25. An electrostatic latent image is formed on the circumferential surface of the photoconductive drum 22 by the irradiation of the laser light. The respective optical scanning devices 24 (a plurality of optical scanning devices) in the respective image forming units 21Y, 21C, 21M and 21Bk irradiate laser light of the respective colors of yellow, cyan, magenta and black to the photoconductive drums 22 of the respective image forming units 21Y, 21C, 21M and 21Bk. When the laser light is irradiated to the uniformly charged circumferential surface of the photoconductive drum 22, electric charges in that irradiated part are erased according to the intensity of the laser light. In this way, the electrostatic latent image is formed on the circumferential surface of the photoconductive drum 22. Note that the image data are, for example, yellow, cyan, magenta and black image data received by the unillustrated interface circuit. These image data are image data generated by applying known processings such as a color correction processing to image signals input from the external apparatus such as a computer.

The transfer device 27 is a device for transferring the toner images formed on the circumferential surfaces of the photoconductive drums 22 to a sheet P. The transfer device 27 includes an intermediate transfer belt 271, primary transfer rollers 272, a drive roller 273, a driven roller 274 and a secondary transfer roller 275.

The intermediate transfer belt 271 is an endless belt and mounted right above the respective image forming units 21Y, 21C, 21M and 21Bk by a plurality of primary transfer rollers 272, the drive roller 273 and the driven roller 274. The intermediate transfer belt 271 is rotatable clockwise by a rotational drive force of the drive roller 273.

The respective primary transfer rollers 272 are arranged to face the respective photoconductive drums 22 of the respective image forming units 21Y, 21C, 21M and 21Bk. The lift of the intermediate transfer belt 271 from the photoconductive drums 22 is prevented by the respective primary transfer rollers 272 pressing the intermediate transfer belt 271. A primary transfer bias is applied to each primary transfer roller 272. When the primary transfer bias is applied to the primary transfer roller 272, the toner image formed on the circumferential surface of the photoconductive drum 22 is primarily transferred to the intermediate transfer belt 271.

The secondary transfer roller 275 is arranged at a position to face the drive roller 273 on the outer circumferential surface of the intermediate transfer belt 271. A secondary transfer bias is applied to the secondary transfer roller 275. When the secondary transfer bias is applied to the secondary transfer roller 275, the toner images primarily transferred to the intermediate transfer belt 271 are secondarily transferred to a sheet P.

A cleaning device 276 for the intermediate transfer belt is provided at the right side of the driven roller 274 in FIG. 1. The toner remaining on the surface of the intermediate transfer belt 271 after the secondarily transfer of the toner images to the sheet P is removed by this cleaning device 276 for the intermediate transfer belt. The surface of the intermediate transfer belt 271 cleaned in this way heads for the photoconductive drums 22.

The fixing unit 30 applies a fixing process by heating to the sheet P carrying the secondarily transferred toner images under the control of the control unit 80. The fixing unit 30 includes a heat roller 31 in which an electric heating element is mounted and a pressure roller 32 arranged such that the circumferential surface thereof faces that of this heat roller 31. The sheet P after the secondary transfer passes a nip portion between the heat roller 31 that is driven and rotated clockwise about a roller shaft and the pressure roller 32 that rotates counterclockwise about a roller shaft following the rotation of the heat roller 31, whereby the fixing process is applied by obtaining heat from the heat roller 31. The sheet P to which the fixing process was applied is discharged to the sheet discharge unit 40 along the sheet conveyance path 50.

The sheet P to which the fixing process was applied in the fixing unit 30 is discharged to the sheet discharge unit 40, which stores this discharged sheet P. The sheet discharge unit 40 is formed by recessing a top part of the apparatus main body 1A. A sheet discharge tray 41 for receiving discharged sheets P is formed at the bottom of a recess.

The sheet conveyance path 50 conveys a sheet P fed from the sheet storage unit 10 to the sheet discharge unit 40 via the image forming station 20 and the fixing unit 30 under the control of the control unit 80.

The temperature sensor 90 detects the temperature of the color printer 1. Specifically, the temperature sensor 90 is disposed within a predetermined short distance from the image forming station 20 (position unaffected to a large extent by a heat source such as the fixing unit 30), detects temperature near the image forming station 20 in the color printer 1 and outputs a detection signal indicating the detected temperature to the control unit 80. Note that the disposed position of the temperature sensor 90 is not limited to this. For example, the temperature sensor 90 may be disposed on an outer side surface of the apparatus main body 1A as shown by dotted line in FIG. 1 and detect the ambient temperature of a place where the color printer 1 is installed. In this case, whether or not temperature differences are easily generated between the optical scanning device used for single-color image formation and the unused optical scanning devices can be precisely determined. Specifically, the temperature sensor 90 may be arranged at a position capable of detecting temperature in any part either inside or outside a housing forming the apparatus main body 1A. However, since other temperature sensors are arranged for the optical scanning devices 24, the temperature sensor 90 is desirably arranged at a position distant from the optical scanning devices 24.

The control unit 80 is connected to the sheet storage unit 10, the image forming station 20, the fixing unit 30, the sheet conveyance path 50, the temperature sensor 90 and the like and controls the operations of these units. The control unit 80 is, for example, configured by a microcomputer including a CPU (Central Processing Unit), a ROM (Read Only Memory) storing various programs to be executed by the CPU, data necessary for the execution of these programs and the like, a RAM (Random Access Memory) which is a so-called working memory of the CPU, peripheral circuits of the CPU and the like.

An image forming operation in the thus configured color printer 1 is described. First, after the circumferential surface of the photoconductive drum 22 is uniformly charged by the charger 23, the circumferential surface is exposed to light by the optical scanning device 24. In this way, an electrostatic latent image is formed on the circumferential surface of the photoconductive drum 22. This electrostatic latent image is developed with the toner supplied by the developing device 25. The toner image formed on the surface of the photoconductive drum 22 is transferred onto the intermediate transfer belt 271 by a transfer bias applied to the primary transfer roller 272. The residual toner remaining on the photoconductive drum 22 without being transferred to the intermediate transfer belt 271 is cleaned by the cleaning device and collected into an unillustrated collection bottle. Such exposing, developing and primary transfer operations are successively performed for each of development colors of yellow, cyan, magenta and black. Toner images of the respective colors are superimposed on the surface of the intermediate transfer belt 271 to form a full-color toner image on the intermediate transfer belt 271.

The full-color toner image primarily transferred to the intermediate transfer belt 271 is secondarily transferred to a sheet P timely conveyed from the sheet storage unit 10 to a transfer position by the sheet conveyance path 50 in a secondary transfer portion where the secondary transfer roller 275 and the intermediate transfer belt 271 are in contact. During this secondary transfer, a secondary transfer bias is applied to the secondary transfer roller 275. The full-color toner image transferred to the sheet P is fixed to the sheet P by heating and pressing by the fixing unit 30. Thereafter, this sheet P is discharged to the sheet discharge unit 40. Note that the toner remaining on the intermediate transfer belt 271 is collected by the cleaning device 276 for the intermediate transfer belt for cleaning the surface of the intermediate transfer belt 271 and collected into the unillustrated collection bottle.

Figure 2:
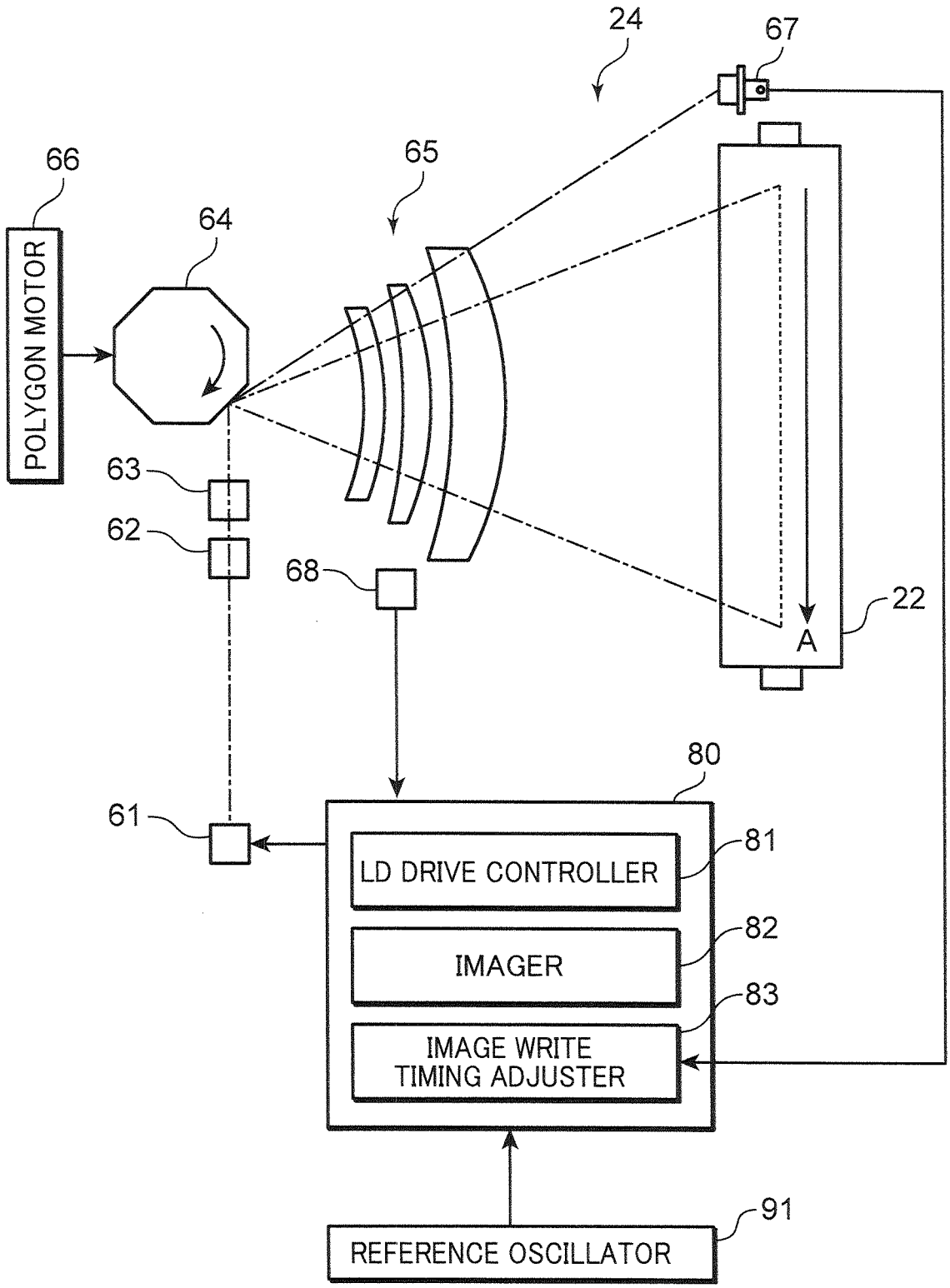
FIG. 2 is a schematic configuration diagram showing the internal configuration of an optical scanning device according to the embodiment.

FIG. 2 is a schematic configuration diagram showing an example of the internal configuration of the optical scanning device 24. Note that since the configurations of the optical scanning devices 24 in the respective image forming units 21Y, 21C, 21M and 21Bk are similar, the following description is made, taking the image forming unit 21Bk as an example.

The optical scanning device 24 includes a laser emitter (light source) 61, a collimator lens 62, a prism 63, a polygon mirror (rotational polygon mirror) 64, an fθ lens 65, a polygon motor (motor) 66, a beam detect sensor (hereinafter, BD (Beam Detect) sensor) 67, and a temperature sensor (first temperature detector) 68. Note that the control unit 80 is electrically connected to each optical scanning device 24.

The laser emitter 61 includes a laser light source such as a laser diode for emitting laser light. Laser light output from the laser light source is converted into parallel light by the collimator lens 62, the prism 63 and the like. This parallel light is reflected toward the polygon mirror 64 by an unillustrated reflecting mirror and incident on the polygon mirror 64 rotated by driving the polygon motor 66.

The polygon mirror 64 includes a plurality of reflecting surfaces for reflecting the laser light output from the laser emitter 61 toward the photoconductive drum 22 and scanning the circumferential surface of the photoconductive drum 22 with this laser light (for example, there are eight reflecting surfaces in FIG. 2). The polygon mirror 64 is driven and rotated, for example, in an arrow direction of FIG. 2 at a constant speed by the polygon motor 66, whereby the laser light emitted from the laser emitter 61 is reflected by the respective reflecting surfaces of the polygon mirror 64.

The fθ lens 65 (optical lens made of resin) is formed by mold-forming optical resin with good optical properties. The fθ lens 65 condenses the laser light reflected by the polygon mirror and focuses it on the circumferential surface of the photoconductive drum 22. By this laser light, the circumferential surface of the photoconductive drum 22 is scanned at a constant speed in a rotary axis direction (main scanning direction, direction of arrow A of FIG. 2) to erase electric charges on the circumferential surface of the photoconductive drum 22. In this way, an electrostatic latent image is formed on the circumferential surface of the photoconductive drum 22.

The BD sensor 67 includes, for example, a photodiode and used to adjust a timing at which beam scanning (hereinafter, referred to as an image writing operation) for forming a toner image (electrostatic latent image) is performed on the photoconductive drum 22. When the laser light reflected by the polygon mirror 64 rotating in the arrow direction shown in FIG. 2 is incident on the BD sensor 67 through the fθ lens 65, a detection signal is output from the BD sensor 67. The detection signal of the BD sensor 67 is input to an image write timing adjuster 83 to be described later and used to adjust an image write timing of the laser light for scanning the circumferential surface of the photoconductive drum 22.

The temperature sensor 68 detects the temperature of the corresponding optical scanning device 24. Specifically, the temperature sensor 68 is arranged outside a laser light path and within a predetermined short distance from the fθ lens 65 in a housing forming an outer body of the optical scanning device 24. The temperature sensor 68 detects temperature near the fθ lens 65 and outputs a detection signal indicating this detected temperature to the control unit 80.

A refractive index of the fθ lens 65 is changed by temperature near the vicinity of the fθ lens 65. Thus, if there are differences between temperatures near the fθ lenses 65 among the respective optical scanning devices 24, refractive indices of the fθ lenses 65 are made different among the respective optical scanning devices 24 by this. Thus, a moving speed of the laser light in the main scanning direction (main scanning magnification) may change among the respective optical scanning devices 24. Therefore, as described later, the respective optical scanning devices 24 are temperature-controlled by the control unit 80 to reduce differences between the temperatures near the fθ lenses 65 among the respective optical scanning devices 24. The detection signal of the temperature sensor 68 is used for the temperature control of each optical scanning device 24.

The color printer 1 includes a reference oscillator 91 for generating a reference clock signal. The control unit 80 obtains an operation timing by the reference clock signal output from the reference oscillator 91. The control unit 80 adjusts an image write timing in accordance with the operation timing in controlling the drive of the laser emitter 61 based on image data of an image to be written.

The control unit 80 functions particularly as an LD drive controller 81, an imager 82 and the image write timing adjuster 83 to control laser light scanning by the optical scanning device 24.

The LD drive controller 81 controls the drive of the laser emitter 61 based on an instruction from the imager 82. The imager 82 starts the drive of the LD drive controller 81 based on image data of an image to be written. The image write timing adjuster 83 adjusts an image write timing, at which the laser light is scanned across the surface of the photoconductive drum 22, based on a BD signal output from the BD sensor 67.

Figure 3:
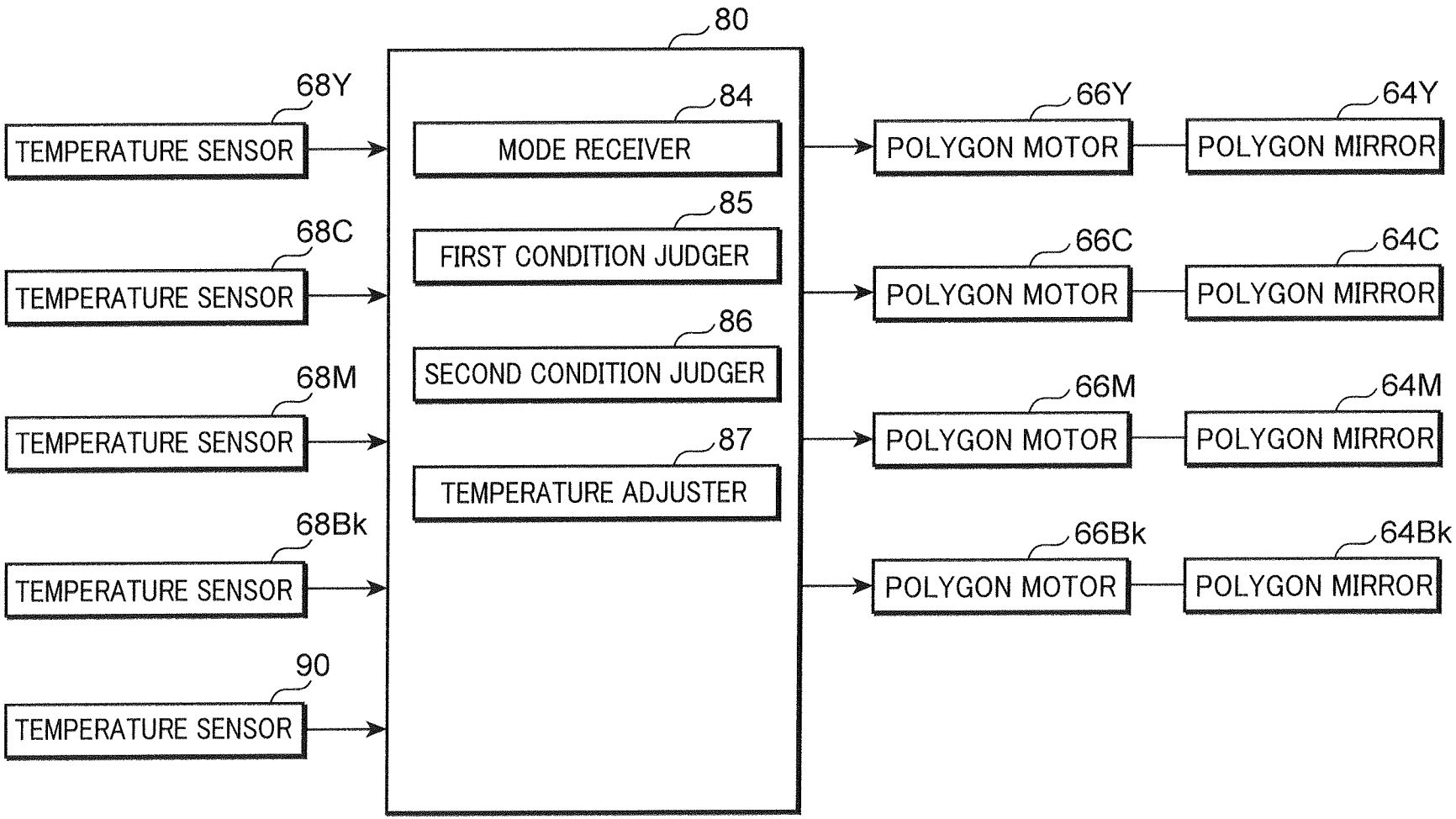
FIG. 3 is a block diagram showing a configuration relating to a temperature control system for the optical scanning devices.

FIG. 3 is a block diagram showing a configuration relating to a temperature control system for the optical scanning devices 24. Note that, in the following description, the polygon mirrors 64 of the optical scanning devices 24 of the respective colors of yellow Y, cyan C, magenta M and black Bk are respectively denoted by "64Y", "64C", "64M" and "64Bk". Further, the polygon motors 66 of the optical scanning devices 24 of the respective colors of yellow Y, cyan C, magenta M and black Bk are respectively denoted by "66Y", "66C", "66M" and "66Bk". Furthermore, the temperature sensors 68 of the optical scanning devices 24 of the respective colors of yellow Y, cyan C, magenta M and black Bk are respectively denoted by "68Y", "68C", "68M" and "68Bk".

The control unit 80 functions to particularly include a mode receiver 84, a first condition judger 85, a second condition judger 86 and a temperature adjuster 87 in association with the temperature control of the optical scanning devices 24 of the respective colors of yellow Y, cyan C, magenta M and black Bk.

The mode receiver 84 receives the selection of a single-color image forming mode for forming an image using only one of the plurality of optical scanning devices 24. Specifically, the mode receiver 84 determines whether an image to be written is a black-and-white image or a full-color image based on image data of the image to be written and receives the selection of the single-color image forming mode when the image to be written is determined to be a black-and-white image as a result of the determination.

Note that, without being limited to this, the mode receiver 84 may be configured to receive the selection of the single-color image forming mode by receiving the operation input of an instruction to form an image using only the optical scanning device 24 of any one of yellow Y, cyan C, magenta M and black Bk from a user via an unillustrated operation input unit such as a touch panel.

The first condition judger 85 judges whether or not a largest temperature difference out of temperature differences between temperature detected by the temperature sensor 68 (first temperature detector) of the optical scanning device of any one color used for image formation out of yellow Y, cyan C, magenta M and black Bk and temperatures detected by the temperature sensors 68 of the optical scanning devices 24 of all the colors but the one satisfies a first condition of being larger than a predetermined first temperature difference.

For example, if the optical scanning device 24 used for image formation is of black Bk, the first condition judger 85 compares temperature detected by the temperature sensor 68Bk and those detected by the temperature sensors 68Y, 68C and 68M of yellow Y, cyan C and magenta M and specifies the largest temperature difference. For example, if the temperature difference from the temperature detected by the temperature sensor 68M of magenta M is largest, the first condition judger 85 judges whether or not the temperature difference between the detected temperature by the temperature sensor 68Bk and that by the temperature sensor 68M satisfies the first condition. Note that the predetermined temperature difference is determined in advance based on an experimental value such as one obtained in trial operation, and stored in the ROM.

The second condition judger 86 judges whether or not temperature detected by the temperature sensor 90 (second temperature detector) satisfies a second condition of being higher than a predetermined temperature. Note that the predetermined temperature is determined in advance based on an experimental value such as one obtained in trial operation and stored in the ROM.

When the selection of the single-color image forming mode is received by the mode receiver 84, the temperature adjuster 87 performs a total motor drive process if the first condition is judged to be satisfied by the first condition judger 85 and the second condition is judged to be satisfied by the second condition judger 86. This total motor drive process is a drive process for driving not only the polygon motor 66 of one optical scanning device 24 for image formation, but also the polygon motors 66 of the optical scanning devices 66 of all the other colors excluding the one optical scanning device 24.

On the other hand, when the selection of the single-color image forming mode is received by the mode receiver 84, the temperature adjuster 87 drives only the polygon motor 66 of the optical scanning device 24 for image formation if the first condition is judged to be satisfied by the first condition judger 85, but the second condition is judged not to be satisfied by the second condition judger 86. Specifically, the temperature adjuster 87 drives only the polygon motor 66 of the one optical scanning device 24 for image formation and does not drive the polygon motors 66 of the optical scanning devices 24 of all the other colors excluding the one optical scanning device 24 under the above condition.

Further, the temperature adjuster 87 stops the polygon motors 66 of the optical scanning devices 24 of all the other colors excluding the one optical scanning device 24 when the largest temperature difference out of temperature differences between the temperature detected by the temperature sensor 68 of the one optical scanning device 24 used for image formation and the temperatures detected by the temperature sensors 68 of the optical scanning devices 24 of all the other colors excluding the one optical scanning device 24 becomes smaller than a second temperature difference smaller than the predetermined temperature difference while the total motor drive process is performed, thus the polygon motors 66 of the all the optical scanning devices 24 are driven.

For example, if the optical scanning device 24 used for image formation is of black Bk, the temperature adjuster 87 compares the temperature detected by the temperature sensor 68Bk and those detected by the temperature sensors 68Y, 68C and 68M of yellow Y, cyan C and magenta M and specifies the largest temperature difference during the execution of the total motor drive process. For example, if the temperature difference from the temperature detected by the temperature sensor 68Y of yellow Y is largest, the temperature adjuster 87 judges whether or not the temperature difference between the detected temperature by the temperature sensor 68Bk and that by the temperature sensor 68Y is smaller than the second temperature difference. If this temperature difference is smaller than the second temperature difference, the temperature adjuster 87 stops the polygon motors 66Y, 66C and 66M. Note that the second temperature difference is determined to be smaller than the predetermined temperature difference based on an experimental value such as one obtained in trial operation, and stored in the ROM.

Figure 4:
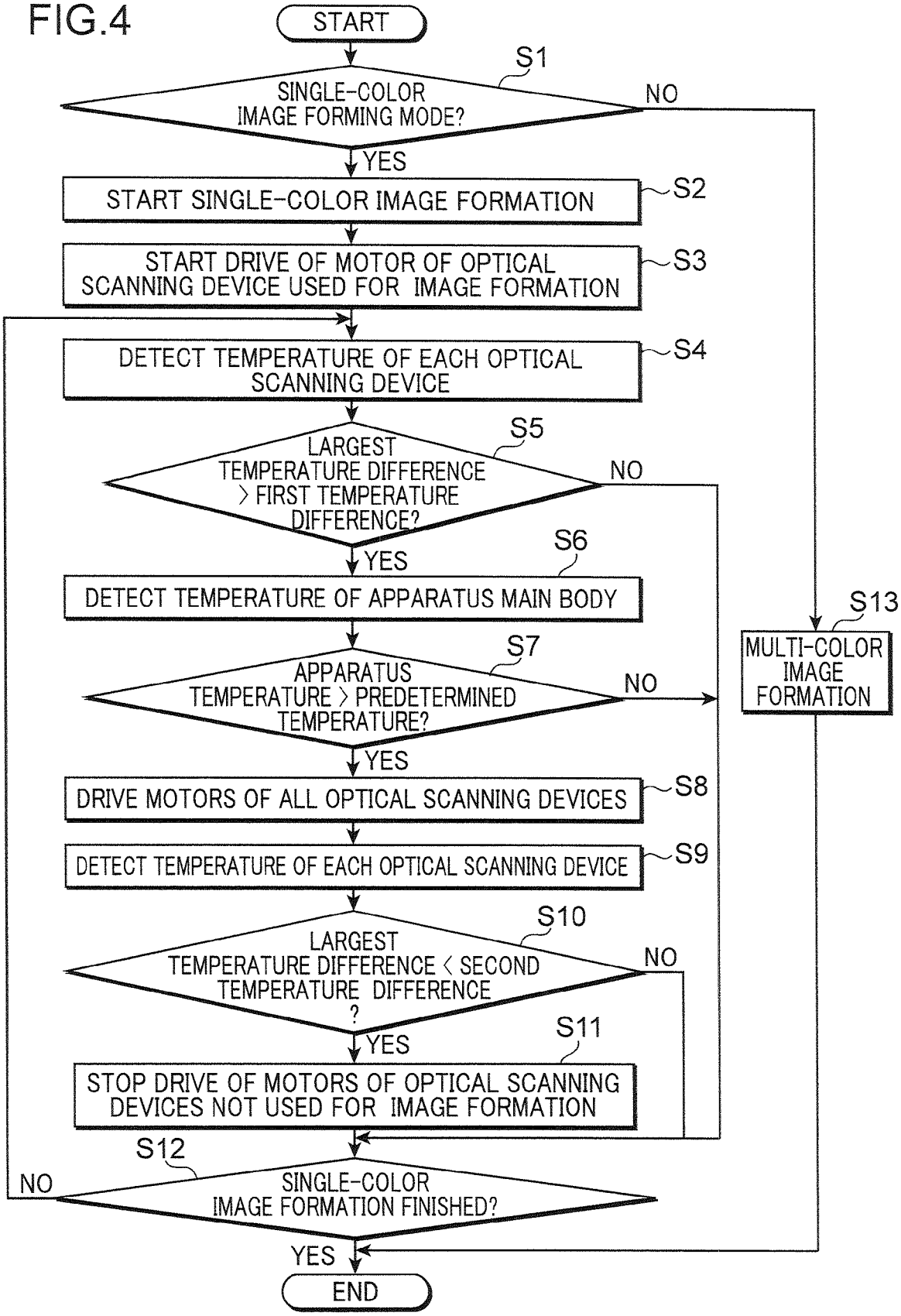
FIG. 4 is a flow chart showing a temperature control operation of the respective optical scanning devices during single-color image formation.
Figure 5:
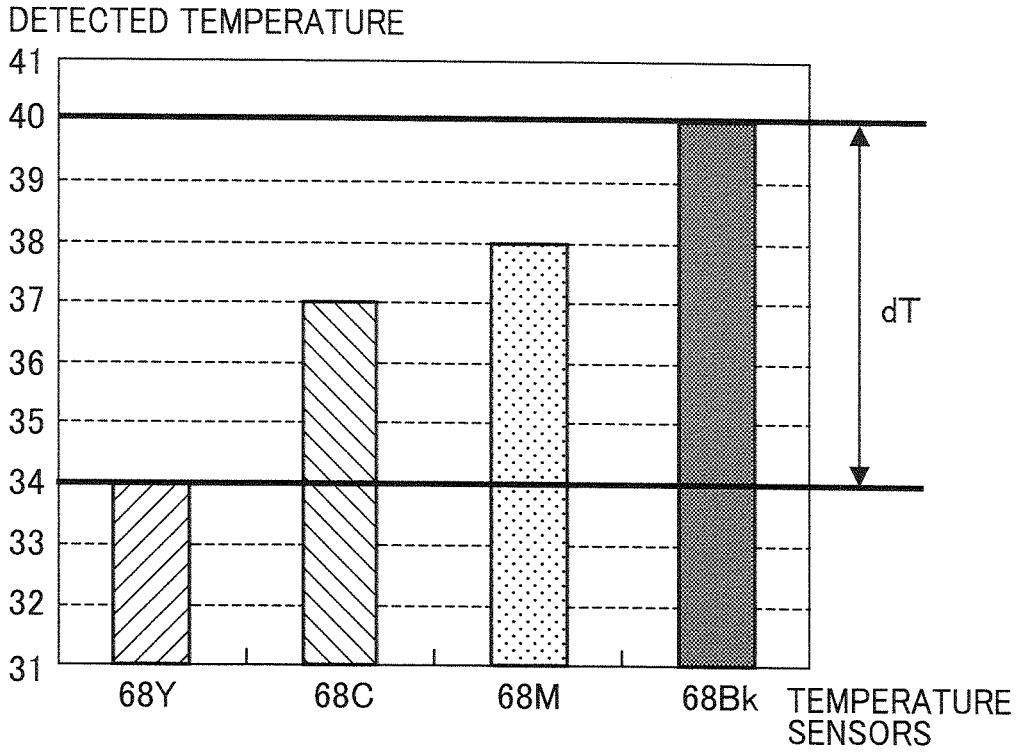
FIG. 5 is a graph showing an example of temperature detected by each temperature detector.

A temperature control operation of the optical scanning devices 24 of the respective colors of yellow Y, cyan C, magenta M and black Bk is described below using FIGS. 4 and 5. FIG. 4 is a flow chart showing the temperature control operation of the optical scanning devices 24 of the respective colors of yellow Y, cyan C, magenta M and black Bk during single-color image formation. FIG. 5 is a graph showing an example of temperatures near the fθ lenses 65 of the optical scanning devices 24 of the respective colors of yellow Y, cyan C, magenta M and black Bk detected by the respective temperature sensors 68Y, 68C, 68M and 68Bk.

Image formation is started by the control unit 80, for example, such as by receiving image data and the input of an instruction to form an image on a sheet based on the image data. When the selection of the single-color image forming mode is received by the mode receiver 84 (S1; YES), image formation using one optical scanning device 24 is started by the control unit 80 (S2) and the drive of the polygon motor 66 of this one optical scanning device 24 is started (S3). Thereafter, laser light output at a predetermined timing by a drive control of the laser emitter 61 by the control unit 80 is reflected (deflected) toward the surface of the photoconductive drum 22 by the polygon mirror 64 that has been started and driven.

On the other hand, if the selection of the single-color image forming mode is not received by the mode receiver 84 (S1; NO), image formation using the optical scanning devices 24 of a plurality of colors is performed by the control unit 80 (S13).

When the drive of the polygon motor 66 of the one optical scanning device 24 used for image formation is started (S3), the temperature adjuster 87 causes the respective temperature sensors 68Y, 68C, 68M and 68Bk to detect temperatures near the fθ lenses 65 of the optical scanning devices 24 of the respective colors of yellow Y, cyan C, magenta M and black Bk (S4).

The following description is made with respect to a specific example in which image formation using the optical scanning device 24 of black Bk is started in Step S2 and the temperatures near the fθ lenses 65 of the optical scanning devices of the respective colors of yellow Y, cyan C, magenta M and black Bk detected by the respective temperature sensors 68Y, 68C, 68M and 68Bk are respectively 34° C., 37° C., 38° C. and 40° C., for example, as shown in FIG. 5.

After the execution of Step S4, the first condition judger 85 obtains temperature differences between the temperature detected by the temperature sensor 68Bk of the optical scanning device 24 of black Bk used for image formation and the temperatures detected by the temperature sensors 68Y, 68C and 68M of the optical scanning devices 24 of yellow M, cyan C and magenta M. Further, the first condition judger 85 judges whether or not the largest temperature difference out of the temperature differences, i.e. a temperature difference dT (6° C.) between the temperature detected by the optical scanning device 24 of black Bk (40° C.) and the temperature detected by the optical scanning device 24 of yellow Y (34° C.) satisfies the first condition of being larger than the predetermined first temperature difference (S5).

Here, the predetermined first temperature difference is, for example, set at 5° C. In this case, the largest temperature difference dT (6° C.) out of the temperature differences between the temperature detected by the temperature sensor 68Bk of the optical scanning device 24 of black Bk used for image formation and the temperatures detected by the temperature sensors 68Y, 68C and 68M of the optical scanning devices 24 of yellow Y, cyan C and magenta M is higher than the predetermined first temperature difference (5° C.). Thus, the first condition judger 85 judges that the first condition is satisfied (S5; YES).

If the first condition is judged to be satisfied by the first condition judger 85 (S5; YES), the temperature adjuster 87 causes the temperature sensor 90 to detect temperature near the image forming station 20 in the color printer 1 (S6). In an embodiment in which the temperature sensor 90 is disposed on an outer side surface of the apparatus main body 1A, ambient temperature (temperature of an environment in which the color printer 1 is arranged) is detected. A specific example in which the temperature detected in Step S6 is 39° C. is described below.

After the execution of Step S6, the second condition judger 86 judges whether or not the temperature (39° C.) near the image forming station 20 detected in Step S6 satisfies the second condition of being higher than the predetermined temperature (S7).

Here, the predetermined temperature is, for example, set at 20° C. In this case, since the temperature detected in Step S6 (39° C.) is higher than the predetermined temperature (20° C.), the second condition judger 86 judges that the second condition is satisfied (S7; YES).

If the second condition is judged to be satisfied by the second condition judger 86 (S7; YES), the temperature adjuster 87 drives not only the polygon motor 66Bk of the optical scanning device 24 of black Bk used for image formation, which has been started and driven in Step 3, but also the polygon motors 66Y, 66C, 66M of the optical scanning devices 24 of yellow Y, cyan C and magenta M (S8).

Thereafter, the temperature adjuster 87 causes the respective temperature sensors 68Y, 68C, 68M and 68Bk to detect the temperatures near the fθ lenses 65 of the optical scanning devices 24 of the respective colors of yellow Y, cyan C, magenta M and black Bk again (S9). Subsequently, the temperature adjuster obtains each of the temperature differences between the temperature detected by the temperature sensor 68Bk of the optical scanning device 24 of black Bk and the temperatures detected by the temperature sensors 68Y, 68C and 68M. When the largest temperature difference out of these temperature differences falls below the second temperature difference (e.g. 3° C.) smaller than the predetermined first temperature difference (5° C.) (S9; YES), the temperature adjuster 87 stops the drive of the polygon motors 66Y, 66C and 66M of the optical scanning devices 24 of yellow Y, cyan C and magenta M driven in Step S8 (S11).

On the other hand, if the largest temperature difference out of the temperature differences between the temperature detected by the temperature sensor 68Bk of the optical scanning device 24 of black Bk used for image formation and the temperatures detected by the temperature sensors 68Y, 68C and 68M of the optical scanning devices 24 of yellow Y, cyan C and magenta M is larger than the second temperature difference (3° C.) in Step S10 (S10; NO), the temperature adjuster 87 continues the drive of the polygon motors 66K, 66Y, 66C and 66M.

If the first condition is judged not to be satisfied by the first condition judger 85 (S5; NO), if the second condition is judged not to be satisfied by the second condition judger 86 (S7; NO) or if the largest temperature difference is not smaller than the second temperature difference (3° C.) in Step S10 (S10; NO) and if the single-color image forming operation started in Step S2 has not finished yet (S12; NO), a return is made to Step S4 to repeat the process. On the other hand, if the single-color image forming operation started in Step S2 is finished (S12; YES), the temperature control for the optical scanning devices 24 of the respective colors of yellow Y, cyan C, magenta M and black Bk is finished in accordance with this.

If the selection of the single-color image forming mode is received by the mode receiver 84 (S1; YES) and the first and second conditions are satisfied (S5; YES, S7; YES), the temperature of the color printer 1 is high to such an extent as to exceed the predetermined temperature. Thus, after image formation started in Step S2 is finished, the temperature of the optical scanning device 24 used for image formation is unlikely to fall and a time period during which the temperature differences among the optical scanning devices 24 are large continues. According to the above embodiment, at such a time, the control unit 80 drives the polygon motors 66Bk, 66Y, 66C and 66M of all the optical scanning devices 24 (S8) to increase the temperature of the optical scanning devices 24 not used for image formation. Thus, the temperature differences among the optical scanning devices 24 can be reduced. In this way, a possibility that color shifts occur due to temperature differences among the optical scanning devices 24 can be reduced.

On the other hand, if the selection of the single-color image forming mode is received (S1; YES) and if the first condition is satisfied, but the second condition is not satisfied (S5; YES, S7; NO), the temperature of the color printer 1 is low to such an extent as not to exceed the predetermined temperature. Thus, after image formation started in Step S2 is finished, the temperature of the optical scanning device 24 used for image formation quickly falls and the time period during which the temperature differences among the optical scanning devices 24 are large is quickly terminated. At such a time, the temperature adjuster 87 does not drive the polygon motors 66Y, 66C and 66M of all the optical scanning devices 24 excluding the optical scanning device 24 used for image formation. Thus, unnecessary power consumption can be avoided.

Further, during the execution of the total motor drive process for driving the polygon motors 66Bk, 66Y, 66C and 66M of all the optical scanning devices 24 by the temperature adjuster 87 (S8), the temperature differences among the respective optical scanning devices 24 might become smaller than the second temperature difference (S10; YES). In this case, if the drive of the polygon motors 66Bk, 66Y, 66C and 66M of all the optical scanning devices 24 is continued also thereafter, the temperatures of all the optical scanning devices 24 excluding the optical scanning device 24 used for image formation increase more than necessary and the temperature differences among the optical scanning devices 24 may be reduced more than necessary. However, according to the above embodiment, if the temperature differences among the respective optical scanning devices 24 become smaller than the second temperature difference during the execution of the total motor drive process (S10; YES), the temperature adjuster 87 stops the motors of all the optical scanning devices excluding the optical scanning device 24 used for image formation (S11). Thus, unnecessary power consumption can be avoided.

Note that, in the above embodiment, the temperature sensor 68 is disposed outside the laser light path and within the predetermined short distance from the fθ lens 65. However, the disposed position of the temperature sensor 68 is not limited to that in the above embodiment.

For example, the temperature sensor 68 may be disposed in contact with an end part of the fθ lens 65 and, thereby, may detect the temperature of the fθ lens 65 itself. Alternatively, the temperature sensor 68 may be arranged at a position as close to the fθ lens 65 as possible in the housing of the optical scanning device 24 if there is no space to dispose the temperature sensor 68 near the fθ lens 65.

The closer to the fθ lens 65 the temperature sensor 68 is arranged, the more accurately the temperature of the fθ lens 65 can be detected. In this way, differences in the refractive index of the fθ lens 65 among the respective optical scanning devices 24 can be accurately reduced by accurately reducing differences in the temperature near the fθ lens 65 among the respective optical scanning devices 24 by the above temperature control.

Further, in the above embodiment, the color printer 1 has been described as an example of the image forming apparatus according to the present invention. The present disclosure can also be applied to copiers, facsimile machines and complex machines with various functions. Further, although the tandem color printer has been described as an example in the above embodiment, another printing method may be adopted if the image forming apparatus is of a type including a plurality of optical scanning devices for scanning a photoconductor with laser light.

Further, the present disclosure can be modified in various manners without being limited to the configuration of the above embodiment. The configuration and process shown in FIGS. 1 to 5 are merely illustration of the embodiment according to the present disclosure and not of the nature to limit the present disclosure to the above embodiment. For example, the embodiment may be modified in a simplified manner by omitting Steps S10 and S11 shown in FIG. 4.

According to the present disclosure as described above, it is possible to provide an image forming apparatus capable of suppressing scan position shifts occurring due to temperature differences among respective optical scanning devices without unnecessarily consuming power.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

What is claimed is:

1. An image forming apparatus, comprising:

an apparatus main body;

a plurality of photoconductors housed in the apparatus main body; and a plurality of optical scanning devices arranged in correspondence with the respective plurality of photoconductors and configured to scan the corresponding photoconductors with laser light; each optical scanning device including a light source for emitting laser light, a rotational polygon mirror for reflecting the laser light output from the light source and scanning the photoconductor, a motor for rotating the rotational polygon mirror, and a first temperature detector for detecting the temperature of the optical scanning device;

a mode receiver for receiving the selection of a single-color image forming mode for forming an image using only one of the plurality of optical scanning devices;

a second temperature detector for detecting the temperature of the apparatus main body;

a first condition judger for judging whether or not a largest temperature difference out of temperature differences between the temperature detected by the first temperature detector of the one optical scanning device and the temperatures detected by all of the first temperature detectors excluding the first temperature detector of the one optical scanning device satisfies a first condition of being larger than a predetermined first temperature difference;

a second condition judger for judging whether or not the temperature detected by the second temperature detector satisfies a second condition of being higher than a predetermined temperature;

a temperature adjuster for performing a total motor drive process for driving the motors of all the optical scanning devices if the first condition is judged to be satisfied by the first condition judger and the second condition is judged to be satisfied by the second condition judger and, on the other hand, driving the motor of the one optical scanning device and not driving the motors of all the optical scanning devices excluding the one optical scanning device if the first condition is judged to be satisfied by the first condition judger and the second condition is judged not to be satisfied by the second condition judger when the selection of the single-color image forming mode is received by the mode receiver; and a control unit configured to carry out a single-color image forming by using the photoconductor corresponding to the one optical scanning device when the selection of the single-color image forming mode is received by the mode receiver and to carry out a plural-color image forming by using the photoconductors corresponding to the plurality of the optical scanning devices when the selection of the single-color image forming mode is not received, wherein the control unit carries out the single-color image forming even though the temperature adjuster performs the total motor drive process if the first and second conditions are judged to be satisfied.

2. An image forming apparatus according to claim 1, wherein:

the temperature adjuster stops the motors of all the optical scanning devices excluding the one optical scanning device when the largest temperature difference out of the temperature differences between the temperature detected by the first temperature detector of the one optical scanning device and the temperatures detected by the first temperature detectors of all the optical scanning devices excluding the one optical scanning device is smaller than a second temperature difference smaller than the predetermined first temperature difference during the execution of the total motor drive process.

3. An image forming apparatus according to claim 1, wherein:

the optical scanning device includes an optical lens made of resin and configured to focus the laser light on a surface of the photoconductor; and the first temperature detector detects the temperature of the optical lens or the temperature near the optical lens.

4. An image forming apparatus according to claim 3, wherein:

the optical lens is an fθlens.

5. An image forming apparatus according to claim 1, further comprising an image forming unit including the plurality of photoconductors and configured to form a toner image, wherein:

the second temperature detector is arranged at a position outside or inside the apparatus main body and distant from the optical scanning devices.

* * * * *